US005810381A

United States Patent [19]

Keller et al.

[11] Patent Number: 5,810,381

[45] Date of Patent: Sep. 22, 1998

[54] SOLE-RETAINING OR BOOT-RETAINING SYSTEM FOR SKI BINDINGS, SNOWBOARD BINDINGS AND THE LIKE

[75] Inventors: Alexander Keller, Unterammergau; Edwin Lehner, Farchant; Harald Schade, St. Heinrich, all of Germany

[73] Assignee: Marker Deutschland GmbH, Eschenlohe, Germany

[21] Appl. No.: 691,270

[22] Filed: Aug. 2, 1996

[30] Foreign Application Priority Data

Aug. 2, 1995 [DE] Germany ..... 195 28 154.3

[51] Int. Cl.[6] ..... A63C 9/00

[52] U.S. Cl. ..... 280/623; 280/631; 280/14.2

[58] Field of Search ..... 280/623, 630, 280/631, 632, 634, 637, 14.2, 621, 622

[56] References Cited

U.S. PATENT DOCUMENTS

| | | | |
|---|---|---|---|
| 3,773,341 | 11/1973 | Mimeur | 280/632 |
| 3,778,073 | 12/1973 | Salomon | 280/632 |
| 3,830,511 | 8/1974 | Unger | 280/634 |
| 3,933,363 | 1/1976 | Schweizer et al. | 280/632 |
| 3,945,658 | 3/1976 | Frechin | 280/621 |
| 4,142,735 | 3/1979 | Biermann et al. | 280/637 |
| 4,165,887 | 8/1979 | Bunn, Jr. | 280/622 |
| 5,362,087 | 11/1994 | Agid | 280/14.2 |

FOREIGN PATENT DOCUMENTS

| | | | |
|---|---|---|---|
| 1056556 | 3/1954 | France | 280/621 |
| 171069 | 8/1934 | Switzerland | 280/637 |
| 218104 | 3/1942 | Switzerland | 280/622 |

*Primary Examiner*—Peter C. English
*Assistant Examiner*—Frank Vanaman
*Attorney, Agent, or Firm*—D. Peter Hochberg

[57] ABSTRACT

A sole-retaining or boot-retaining system for ski bindings, snowboard bindings and the like. A cable release arrangement is provided to ergonomically move a sole-retaining or boot-retaining member between a closed or "clamped-in" position, wherein the sole or boot is secured to the binding and an open or "release" position, wherein the sole or boot is releasable from the binding.

14 Claims, 2 Drawing Sheets

SOLE-RETAINING OR BOOT-RETAINING SYSTEM FOR SKI BINDINGS, SNOWBOARD BINDINGS AND THE LIKE

FIELD OF THE INVENTION

The present invention relates generally to a sole-retaining or boot-retaining system for ski bindings, snowboard bindings and the like. More particularly, the present invention relates to a sole-retaining or boot-retaining system having a retaining member which is movable between a closed or "clamped-in" position, in which the sole or the boot is fixed to the binding, and an open or "release" position, in which the sole or the boot is releasable from the binding. The retaining system also includes an actuating lever which is directly connected or operatively connected to the retaining member for moving the retaining member between the open and closed positions. The actuating lever pivots between positions corresponding to the open and closed positions of the retaining member, as the retaining member is moved between the open and closed positions. Moreover, the actuating lever may be shifted counter to a resistance or spring force, to voluntarily move the retaining member from the closed position to the open position.

BACKGROUND OF THE INVENTION

Many prior art sole-retaining or boot-retaining arrangements are known for use with current ski bindings, snowboard bindings and the like. In order to be able to use prior art bindings as so-called "step-in" bindings, the retaining member is often provided with a tread spur or a tread plate, or is operatively coupled thereto. The tread spur or tread plate is forced downwards when a boot is introduced into the binding, and thus moves the retaining member from the open position into the closed position.

Prior art retaining arrangements also include an actuating lever, which functions primarily to move the retaining member from the closed position into the open position. The actuating lever is frequently designed and arranged such that it may be actuated by means of a ski pole or the like. However, situations may arise, for example, after a skier has fallen, in which actuation by means of the ski pole is not possible or is only possible with great difficulty. Moreover, snowboarders do not usually use ski poles. While manual operation of the actuating lever is possible, in most cases it is extremely inconvenient.

The present invention overcomes these and other drawbacks of prior art retaining systems.

SUMMARY OF THE INVENTION

The present invention is based on the general idea of considerably simplifying the adjustment of an actuating lever for moving a binding retaining member from the closed position to the open position. In this respect, a cable release arrangement is provided for engagement with the lever. The cable release arrangement includes a cable for moving the retaining member from the closed or "clamped-in" position to the open or "release" position. In a preferred embodiment, the cable release arrangement is arranged between the lever and an abutment member which is arranged essentially stationary relative to the ski, snowboard or the like.

Importantly, the cable release arrangement considerably reduces the force necessary to move the retaining member. Moreover, the manipulations required to move the retaining member are made more favorable in ergonomic terms. For instance, according to a preferred embodiment of the present invention, all that is required to move the retaining member from the closed position to the open position is to pull a cable in a direction vertically upward relative to the ski, snowboard or the like using a handle or the like attached thereto.

According to a preferred embodiment of the present invention, the cable release arrangement includes a spring-loaded reel, which is preferably located in the handle. When the handle is released, putting the cable release arrangement in the inactive state, the spring-loaded reel automatically winds up any excess cable using a spring force or the like. This prevents the formation of a slack cable which could cause a malfunction of the retaining member or impair use of the binding.

It is an object of the present invention to provide an improved sole-retaining or boot-retaining system having simple and effective operating means.

It is another object of the present invention to provide a retaining system having an actuating lever for moving a retaining member between a closed position and an open position, wherein operation of the lever is considerably simplified.

It is yet another object of the present invention to provide a retaining system that considerably reduces the forces necessary to operate a lever for moving a retaining member from the closed position to the open position.

It is still another object of the present invention to provide a retaining system that has an ergonomic design to facilitate operation of the retaining member to move it between the closed and open positions.

It is still another object of the present invention to provide a retaining system having a cable release arrangement for facilitating the movement of the retaining member from the closed position to the open position.

These and other objects will become apparent from the following description of preferred embodiments taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENT

Figure 1:
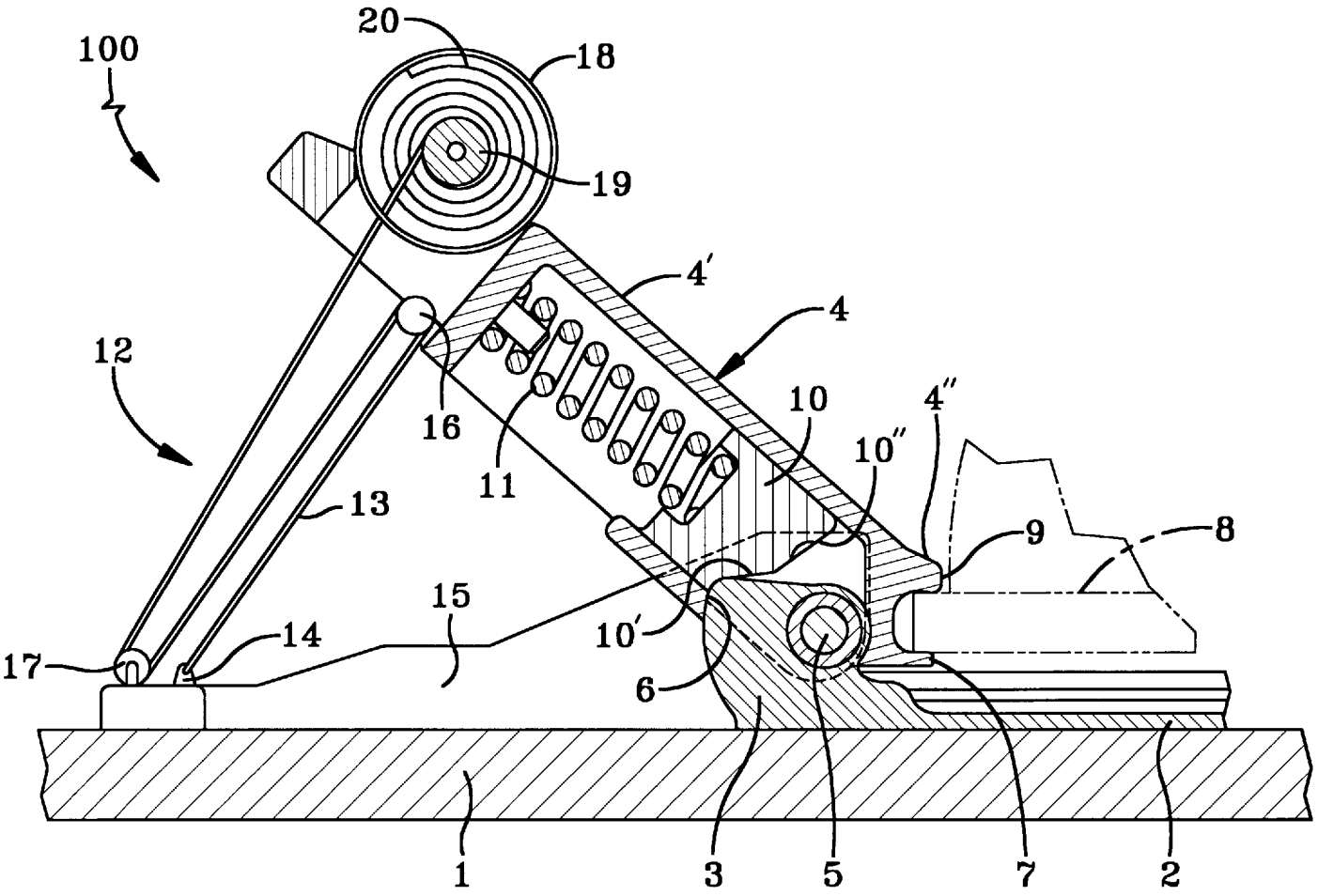
FIG. 1 is a side sectional view of a retaining system illustrating a first embodiment of the present invention.

Referring now to the drawings wherein the showings are for the purpose of illustrating preferred embodiments of the invention only, and not for the purpose of limiting same, FIG. 1 shows a binding 100 having a sole-retaining means 4. It should be appreciated that only a portion of binding 100 is shown in FIG. 1. Sole-retaining means 4 is mounted on a bearing block 3, such that it may be pivoted about a bearing pin 5 arranged parallel to the upper side of a snowboard 1. Bearing block 3 is fastened to or integrally formed on snowboard 1. Alternatively, bearing block 3 may be fastened to or integrally formed on a member fixed to snowboard 1, such as binding baseplate 2. Bearing block 3 has a cam-like protrusion 6, the function of which will be explained in detail below.

Sole-retaining means 4 is designed in the form of a double-armed lever, including a long lever arm 4' and a short lever arm 4". Short lever arm 4" includes a tread spur 7 which interacts with the lower surface of a boot sole 8, and a protrusion 9 which interacts with the upper surface of boot sole 8 to hold down boot sole 8 when boot sole 8 is introduced into binding 100, and tread spur 7 is pressed down against the upper side of snowboard 1 or of baseplate 2. As a result of the downward movement of tread spur 7, sole-retaining means 4 pivots to the closed or "clamped-in" position shown in FIG. 1. Furthermore, protrusion 9 engages with the upper surface of boot sole 8.

Long lever arm 4' of sole-retaining means 4 includes a generally tubular region dimensioned to receive a piston 10, which is movable in the tubular region in a displaceable manner. Piston 10 is biased against cam-like protrusion 6 of bearing block 3 by means of a helical compression spring 11. Helical compression spring 11 is supported on an abutment member formed in lever arm 4'. An oblique surface 10' and a latching recess 10" are formed at a first side of piston 10 which faces cam-like protrusion 6. Oblique surface 10' interacts with cam-like protrusion 6, under the force of helical compression spring 11. As a result, a pronounced torque is exerted on sole-retaining means 4 in the clockwise direction as soon as oblique surface 10' comes to bear against cam-like protrusion 6. The torque is so pronounced that the border of boot sole 8 which is gripped by protrusion 9 is held with a very high force against baseplate 2 or the upper side of snowboard 1.

Latching recess 10" is located adjacent to oblique surface 10'. Cam-like protrusion 6 engages with the surfaces defining recess 10", when sole-retaining means 4 is pivoted in the counter-clockwise direction from the closed position (FIG. 1) to the open position. As sole-retaining means 4 is pivoted in the counterclockwise direction, lever arm 4' approaches the upper side of snowboard 1. Latching recess 10" is dimensioned such that the latching forces holding sole-retaining means 4 in the open position are limited. Accordingly, latching recess 10" does not impede tread spur 7 from being pressed downward by boot sole 8, thus moving sole-retaining means 4 to the closed position. When tread spur 7 is pressed downward, oblique surface 10" is forced to slide onto cam-like protrusion 6 as a result of sole-retaining means 4 pivoting in the clockwise direction. Accordingly, sole-retaining means 4 will automatically pivot into the closed position shown in FIG. 1 when boot sole 8 is pressed downward. It should be appreciated that lever arm 4' of sole-retaining means 4 may be used as a handle to pivot sole-retaining means 4 about bearing pin 5, thus moving it between the closed position (FIG. 1) and the open position.

The bias force of spring 11, and the angle of the oblique arrangement of oblique surface 10' allows protrusion 9 to be held from above with a strong force against the upper surface of boot sole 8. Accordingly, boot sole 8 is biased against the upper side of snowboard 1, even if a relatively thick layer of snow, ice or the like is adhered beneath boot sole 8. It should be appreciated that when boot sole 8 is introduced into the binding, a layer of snow, ice or the like on the lower surface of boot sole 8 may be forced under pressure off sole 8, or may melt over time. Binding 100 can accommodate a large snow spanning height, and thus boot sole 8 can be reliably secured to the binding even in the case where a relatively thick layer of snow is adhered to the bottom of boot sole 8.

According to a preferred embodiment of the present invention, a cable release arrangement 12 is provided to facilitate movement of sole-retaining means 4 from the closed position to the open position. Cable release arrangement 12 takes the form of a block and tackle arrangement. In this respect, a cable 13 is fixed to an abutment member 14, which is arranged on a lateral continuation 15 of bearing block 3 or of baseplate 2. From abutment member 14, cable 13 travels through a first pulley 16, which is arranged in the vicinity of the free end of lever arm 4'. From first pulley 16, cable 13 travels through a second pulley 17, which is arranged on continuation 15. Continuing from second pulley 17, cable 13 extends through an eyelet formed at the free end of lever arm 4' to a spherical gripping member 18.

A spring-loaded reel 19 is arranged within gripping member 18. Cable 13 is fixedly connected to reel 19. A helical spring 20 subjects reel 19 to a limited torque. Accordingly, reel 19 tries to wind up excess cable 13 with a relatively low force and tries to bring gripping member 18 to bear against lever arm 4'.

The operation of cable release arrangement 12 will now be described with reference to FIG. 1. Cable release arrangement 12 is activated when gripping member 18 is initially drawn vertically upward relative to the snowboard 1. As a result, the section of cable 13 wound on reel 19 is unwound. As gripping member 18 is drawn further in the vertically upward direction, sole-retaining means 4 pivots in the counter-clockwise direction from the position shown in FIG. 1, towards continuation 15. As a result, sole-retaining means 4 moves from the closed position (FIG. 1) to the open position. Sole-retaining means 4 is secured in the open position by interaction of cam-like protrusion 6 with latching recess 10", of piston 10. When gripping member 18 is released, cable release arrangement 12 is deactivated. As a result, the entire excess cable 13 is rewound on reel 19 and gripping member 18 comes to rest resiliently against sole-retaining means 4 in the same manner as shown in FIG. 1.

If a boot sole 8 is subsequently introduced into binding 100, causing tread spur 7 to be pressed downward, sole-retaining means 4 will pivot in the clockwise direction, thus moving from the open position to the closed position (FIG. 1). As a result, a section of cable 13 having a length sufficient to pivot sole-retaining means 4 will be unwound from spring-loaded reel 19.

Figure 2:
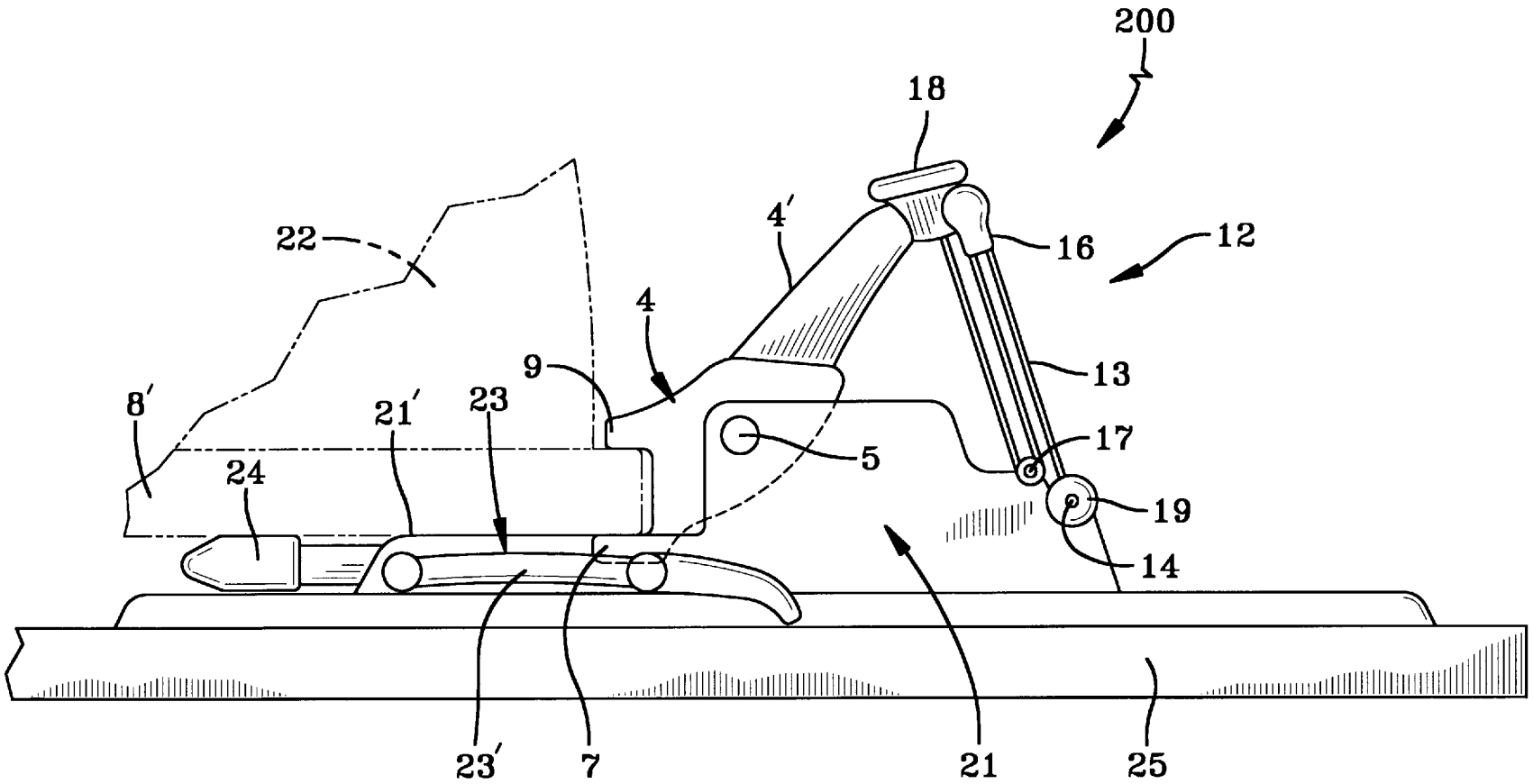
FIG. 2 is a plan side view of a retaining system illustrating a second embodiment of the present invention.

FIG. 2 illustrates a second embodiment of the present invention. A binding 200 includes a sole-retaining means 4. It should be appreciated that only a portion of binding 200 is shown in FIG. 2. Sole-retaining means 4 is secured to a ski 25 such that it can be pivoted about a bearing pin 5. Bearing pin 5 is arranged on a housing 21 and extends in a direction transverse to the longitudinal axis of ski 25. Housing 21 is oriented in a direction generally parallel to the longitudinal axis of ski 25. Moreover, housing 21 may be displaced rightward in FIG. 2, counter to a force exerted by a thrust-action spring means (not shown). The left end of housing 21 forms a standing surface 21' for the heel region of a ski boot 22. Standing surface 21' also provides a bearing for a ski brake 23 having braking arms 23'. Ski brake 23 is retained in a conventionally known manner by means of a spring-loaded pedal 24. In FIG. 2, ski brake 23 is shown in a non-braking position, wherein ski boot 22 is positioned on standing surface 21' of housing 21. As soon as ski boot 22 is raised upward, pedal 24 pivots upward in a clockwise direction. As a result, braking arms 23' will engage with the snow along the side of ski 25 to provide a braking action.

Housing 21 also accommodates a latching arrangement (not shown), which may take the form of the spring-loaded piston and bearing arrangement shown in FIG. 1. In a conventionally known manner, the latching arrangement secures sole-retaining means 4 in the closed or "clamped-in" position (FIG. 2) with a comparatively high latching force, and secures sole-retaining means 4 in an open or "release" position with a lower latching force. As in the case of the first embodiment discussed above, sole-retaining means 4 is movable between a closed position (FIG. 2) and an open position. In this respect, sole-retaining means 4 is pivotable about bearing pin 5.

Sole-retaining means 4 latches in the closed position with a relatively large range of elasticity. In this respect, when sole-retaining means 4 is pivoted from the closed position (FIG. 2) through only a limited angle in the clockwise direction, it is forced back into the closed position. Sole-retaining means 4 will move to the open position only when it has been pivoted in the clockwise direction through a relatively large angle. Accordingly, binding 200 can accommodate a large snow spanning height. In this respect, boot sole 8' is reliably secured to the binding even where a thick layer of snow, ice or the like is adhered to the bottom of boot sole 8'. Moreover, the undesired opening of the binding in the event of a brief impact loading is also prevented.

Sole-retaining means 4 includes a tread spur 7 and a protrusion 9. When boot 22 is introduced into binding 200, tread spur 7 is pushed downward, thus moving sole-retaining means 4 into the closed position shown in FIG. 2. As a result, protrusion 9 prevents the heel region of boot sole 8' from being lifted upwards away from the upper side of ski 25.

A lever arm 4' is provided to move sole-retaining means 4 between the closed position (FIG. 2), and the open position. Lever arm 4' pivots in the clockwise direction to move sole-retaining means 4 from the closed position to the open position, and pivots in the counter-clockwise direction to move sole-retaining means 4 from the open position to the closed position. It should be appreciated that a ski pole may be used to pivot lever arm 4'.

A cable release arrangement 12 having a cable 13 is provided to facilitate the movement of sole-retaining means 4 from the closed position to the open position. Cable 13 is fixed to an abutment member 14 arranged on housing 21. From abutment member 14, cable 13 travels through a first pulley 16, which is arranged on lever arm 4'. From first pulley 16, cable 13 travels through a second pulley 17 arranged on housing 21. Continuing from second pulley 17, cable 13 extends through an eyelet formed on lever arm 4' and to a gripping member 18.

A spring-loaded reel 19 is arranged on abutment member 14 in the embodiment shown in FIG. 2. However, it should be appreciated that reel 19 may alternatively be arranged in gripping member 18, as in the embodiment shown in FIG. 1. Reel 19 is provided to wind up excess cable 13.

The operation of a cable release arrangement 12 will now be described with reference to FIG. 2. Cable release arrangement 12 is activated when gripping member 18 is initially drawn vertically upward relative to ski 25. As a result, the section of cable 13 wound on reel 19 is unwound. As gripping member 18 is drawn further in the vertically upward direction, lever arm 4' is forced to pivot in the clockwise direction. As a result, sole-retaining means 4 moves to the open position. Cable release arrangement 12 is deactivated when gripping member 18 is subsequently released. As a result, the excess cable 13 is rewound on reel 19 and gripping member 18 comes to rest against lever arm 4' in the same manner as shown in FIG. 2.

If boot sole 8' is subsequently introduced into binding 200 causing tread spur 7 to be pressed downward, sole-retaining means 4 will pivot in the counter-clockwise direction, thus moving from the open position to the closed position (FIG. 2). As a result, a section of cable 13 having a length sufficient to pivot sole-retaining means 4 will be unwound from spring-loaded reel 19.

It should be appreciated that the present invention may be used with a binding mounted to a ski, a snowboard and the like, and is not limited to the arrangements shown in FIGS. 1 and 2.

The foregoing description is directed to specific embodiments of the present invention. It should be appreciated that these embodiments are described for purposes of illustration only, and that numerous alterations and modifications may be practiced by those skilled in the art without departing from the spirit and scope of the invention. For instance, an extension cable or band may be fastened onto gripping member 18. The extension cable or band is then fastened at a level above the binding. In this respect, the extension cable or band may be fastened on a skier's or snowboarder's belt or article of clothing. As a result, it is possible for the skier or snowboarder to activate cable release arrangement 12 without having to bend down to the binding.

In addition, lever arm 4' may be arranged such that it can be pivoted in a direction different from those shown in FIGS. 1 and 2. Moreover, lever arm 4' may pivot in a plane approximately parallel to the upper side of snowboard 1 or ski 25. In this case, abutment member 14 is arranged such that lever arm 4' approaches abutment member 14 as boot-retaining or sole-retaining means 4 moves to the open position.

Furthermore, gripping member 18 or other actuating member may be fastened at the end of cable 13 which is furthest from lever arm 4' provided that this end of cable 13 is secured such that it can be moved relative to continuation 15 or relative to housing 21. For instance, cable 13 may be moved by means of a pulley arranged at that end thereof.

It is intended that all such modifications and alterations be included insofar as they come within the scope of the invention as claimed or the equivalents thereof.

The invention claimed is:

1. A sole-retaining or boot-retaining system for a binding usable with a ski, or a snowboard, said system comprising:

retaining means movable between a closed position, wherein the sole or the boot is secured to the binding, and an open position, wherein the sole or the boot is releasable from the binding, said retaining means having lever means for moving said retaining means between the closed and open positions, said lever means pivoting between a first position corresponding to the closed position and a second position corresponding to the open position;

bias means for providing a biasing force to resist movement of said lever means between said first and second positions;

cable means engageable with said lever means for moving said lever means between said first and second positions, said cable means having a first and a second end;

gripping means engageable with said cable means to facilitate the movement of said cable means; and spring-loaded reel means for winding thereupon excess cable means.

2. A sole-retaining or boot-retaining system according to claim 1, wherein said system further comprises an abutment means for holding one end of said cable means at a fixed location.

3. A sole-retaining or boot-retaining system according to claim 2, wherein said system further comprises a plurality of pulley means arranged between said lever means and abutment means for receiving and guiding said cable means.

4. A sole-retaining or boot-retaining system according to claim 1, wherein said gripping means facilitates the gripping and movement of said cable means in a direction generally vertically upward relative to the ski or the snowboard when said system is fixed to the ski or snowboard.

5. A sole-retaining or boot-retaining system according to claim 4, wherein movement of said cable means in a direction generally vertical upward relative to the ski or snowboard, when said system is attached to the ski or snowboard, moves said lever means from said first position to said second position.

6. A sole-retaining or boot-retaining system according to claim 1, wherein said reel means includes a spring means for biasing said gripping means against said lever means.

7. A sole-retaining or boot-retaining system according to claim 1, wherein said reel means includes a spring means for biasing said gripping means against a portion of said system that is essentially stationary.

8. A sole-retaining or boot-retaining system, said system comprising:

a snowboard;

a binding attached to said snowboard;

retaining means movable between a closed position, wherein the sole or the boot is secured to the binding, and an open position, wherein the sole or the boot is releasable from the binding, said retaining means having lever means for moving said retaining means between the closed and open positions, said lever means pivoting between a first position corresponding to the closed position and a second position corresponding to the open position;

bias means for providing a biasing force to resist movement of said lever means between said first and second positions;

cable means engageable with said lever means for moving said lever means between said first and second positions, said cable means having a first and a second end;

gripping means engageable with said cable means to facilitate the movement of said cable means; and spring-loaded reel means for winding thereupon excess cable means.

9. A sole-retaining or boot-retaining system according to claim 8, wherein said system further comprises an abutment means fixed relative to said snowboard, said cable means engageable with said abutment means.

10. A sole-retaining or boot-retaining system according to claim 9, wherein said system further comprises a plurality of pulley means arranged between said lever means and abutment means for receiving and guiding said cable means.

11. A sole-retaining or boot-retaining system according to claim 8, wherein said gripping means engageable with said cable means to facilitate the movement of said cable means in a direction generally vertically upward relative to the snowboard.

12. A sole-retaining or boot-retaining system according to claim 11, wherein movement of said cable means in a direction generally vertical upward relative to said snowboard moves said lever means from said first position to said second position.

13. A sole-retaining or boot-retaining system according to claim 8, wherein said reel means includes a spring means for biasing said gripping means against said lever means.

14. A sole-retaining or boot-retaining system according to claim 8, wherein said reel means includes a spring means for biasing said gripping means against a portion of said system essentially stationary relative to said snowboard.

* * * * *